United States Patent [19]

Daws

[11] Patent Number: 4,611,865

[45] Date of Patent: Sep. 16, 1986

[54] DISPLAY STAND

[75] Inventor: Bryan E. Daws, Phoenix, Ariz.

[73] Assignee: Phoenix Newspapers, Inc., Phoenix, Ariz.

[21] Appl. No.: 574,846

[22] Filed: Jan. 30, 1984

[51] Int. Cl.[4] ..... A47F 3/00

[52] U.S. Cl. ..... 312/114; 312/284; D20/6

[58] Field of Search ..... 206/45.21, 45.22, 45.23; 312/100, 114, 208, 245, 284; 248/444.1, 459; D20/1, 4, 6

[56] References Cited

U.S. PATENT DOCUMENTS

| | | | |
|---|---|---|---|
| D. 273,023 | 3/1984 | Chalabian | D20/6 |
| 556,612 | 3/1896 | Bingaman | 312/245 |
| 2,110,429 | 3/1938 | Sunderhauf | 248/549 |
| 2,779,649 | 1/1957 | Neilson | 312/245 |
| 2,822,230 | 2/1958 | Curran | 312/100 X |
| 2,982,568 | 5/1961 | Wolfe | 248/444.1 |
| 3,086,658 | 4/1963 | Palmer | 248/444.1 |
| 3,645,594 | 2/1972 | Cintz | 312/100 |
| 3,915,525 | 10/1975 | Taube | 312/284 |
| 4,044,986 | 8/1977 | Cummins | 248/459 X |
| 4,313,043 | 1/1982 | White et al. | 312/245 |

*Primary Examiner*—James T. McCall
*Assistant Examiner*—Joseph Falk
*Attorney, Agent, or Firm*—Harry M. Weiss & Associates

[57] ABSTRACT

An improved display stand is disclosed which holds periodicals such as newspapers and magazines. The periodicals are placed on a bottom plate which is inside a U-shaped hood supported by a support which is inclined. A hinged lid is provided which can be easily opened and closed. The lid is kept shut by gravity. In addition, the angle at which the support is inclined prevents the periodicals from falling out of the display stand. The display stand is economical to construct and easy to fabricate because it is comprised of a minimum number of parts.

19 Claims, 20 Drawing Figures

FIG. 1
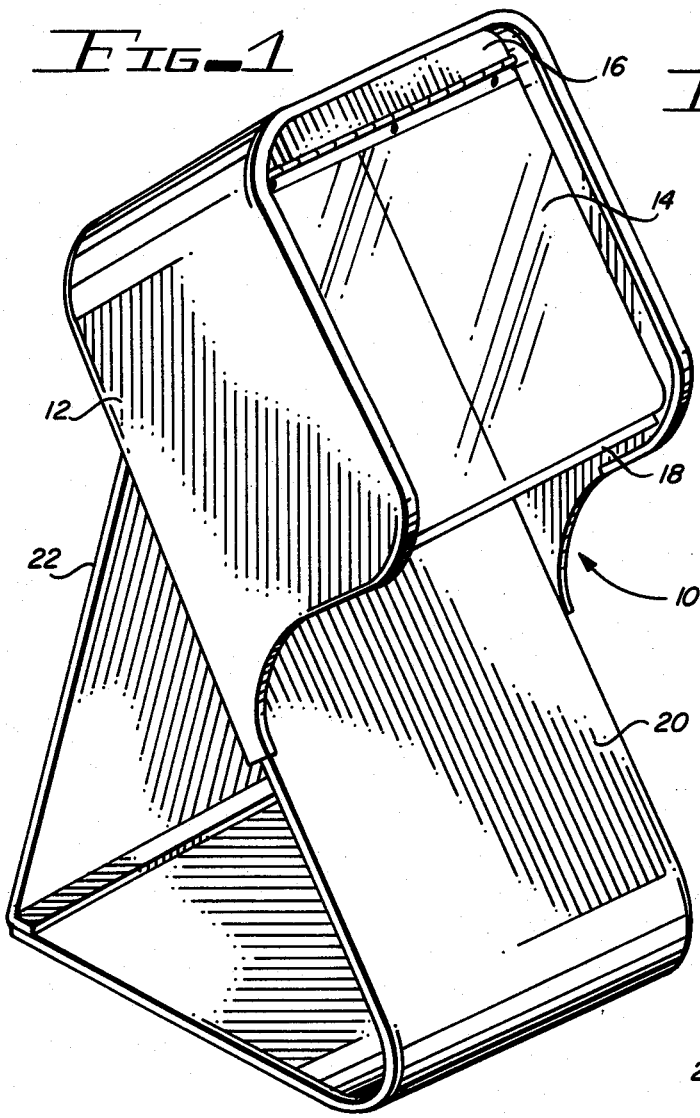
FIG. 2
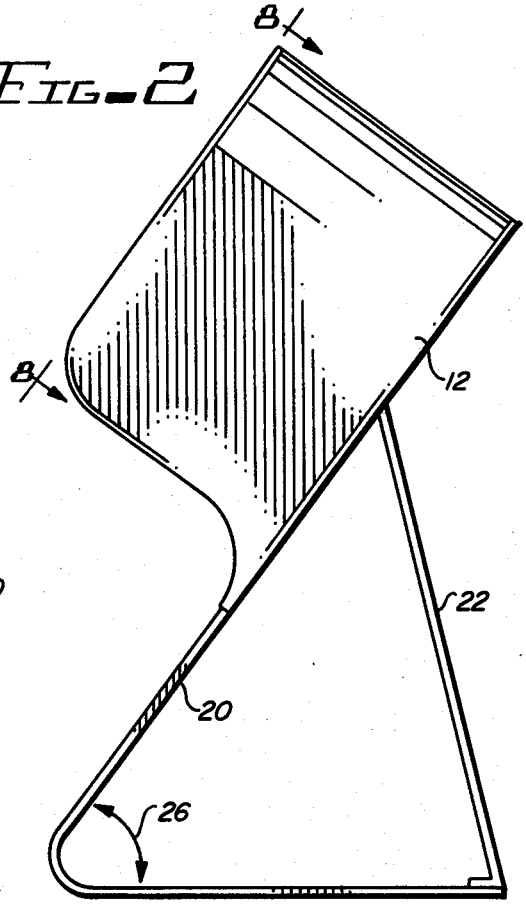
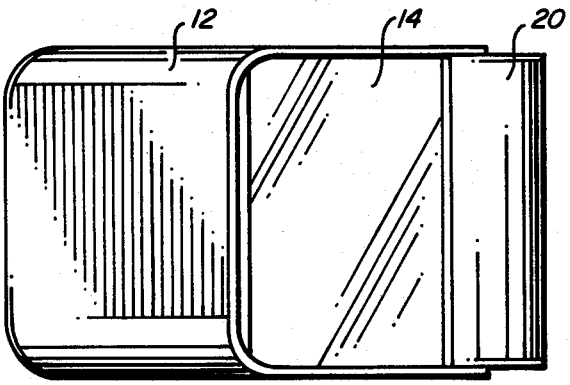
FIG. 3
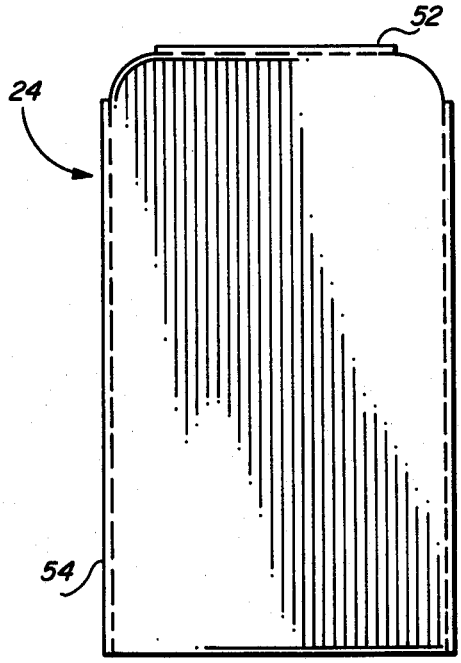
FIG. 12
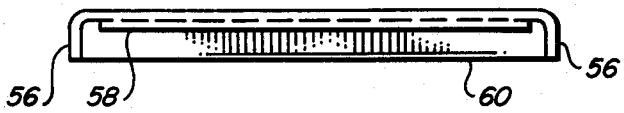
FIG. 15

DISPLAY STAND

BACKGROUND OF THE INVENTION

1. Field of the Invention

This invention relates generally to display stands and, more specifically, to a display stand used to display and make readily accessible to the public newspapers, magazines, and other periodicals.

2. Description of the Prior Art

In the past, a variety of display stands have been used for the purpose of selling periodicals such as newspapers to the public. Such display stands typically have a locking device which may be opened by inserting coins into a mechanism. As a result, the newspapers are secured and protected from external elements by a lid which is locked shut. However, in the case of a display stand used for offering newspapers, magazines or other periodicals to the public free of charge, the lid must stay shut without the benefit of a locking mechanism. In addition, some means must be provided for the purpose of preventing the periodicals from spilling or falling out of the display stand. The latter problem can be solved through the use of a display stand that is orientated (sloped or inclined) in such a manner to prevent periodicals from falling out of the stand. Moreover, a lid may be mounted on the display stand which uses gravity to stay shut. Such a lid would allow access to the public while still protecting the contents of the display stand from external elements.

Since the distribution of periodicals such as newspapers requires a large number of display stands, it is important that a display stand used for this purpose be both easy to construct and economical to fabricate. As such, a display stand is needed which may be easily constructed with a minimum number of parts. Such a display stand must be both functional and attractive and must have the capacity to hold a large number of periodicals.

Accordingly, a need exists for a display stand used for offering a large number of periodicals such as newspapers to the public free of charge which provides ready access to the public while protecting its contents from external elements. Another need exists for a display stand that is easy to construct and economical to make. A further need exists for a display stand that is orientated to prevent periodicals from falling out of the stand.

SUMMARY OF THE INVENTION

It is an object of this invention to provide an improved display stand.

It is another object of this invention to provide an improved display stand that can be used to offer periodicals such as newspapers to the public free of charge which provides ready access to the public while protecting the periodicals from external elements.

It is a further object of this invention to provide an improved display stand that holds a large number of periodicals and is economical to fabricate and easy to construct.

It is still another object of this invention to provide an improved display stand that is orientated in such a way to prevent periodicals from falling out of the stand.

In accordance with one embodiment of this invention, a display stand for holding a plurality of periodicals such as newspapers or magazines is disclosed. The periodicals are placed on a bottom plate which is inside a U-shaped hood supported by a support which is inclined. A hinged lid is provided which can be easily opened and closed. The lid is kept shut by gravity. In addition, the angle at which the support is inclined prevents the periodicals from falling out of the display stand. The display stand is economical to construct and easy to fabricate because it is comprised of a minimum number of parts.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 1 is a perspective view of a display stand which is an embodiment of the present invention.

FIG. 2 is a side elevational view of the display stand of FIG. 1.

FIG. 3 is a top plan view of the display stand of FIG. 1.

FIG. 12 is a rear elevational view of the backside of the display stand of FIG. 1.

FIG. 15 is a front elevational view of the bottom plate shown in FIG. 14.

DETAILED DESCRIPTION OF THE INVENTION

Figure 4:
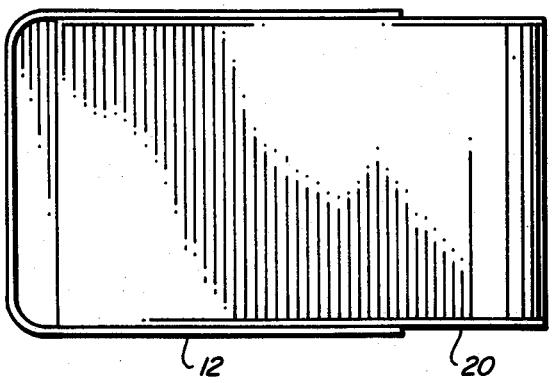
FIG. 4 is a bottom plan view of the display stand of FIG. 1.

Referring to FIG. 1, a perspective view of a display stand, generally designated by reference number 10, is shown that may be used for the purpose of distributing periodicals such as newspapers or magazines to the public. The display stand 10 is comprised of a hood 12, lid 14, hinged top portion 16, bottom plate 18, backside 24 (see FIGS. 7, 12, and 13) and a support means consisting of an angled support 20 and a straight support 22. FIG. 2 is a side elevational view of the display stand 10. Note that the angled support 20 is bent during fabrication to form an angle designated by reference number 26. FIGS. 3 and 4 are top and bottom plan views, respectively, of the display stand 10.

Figure 5:
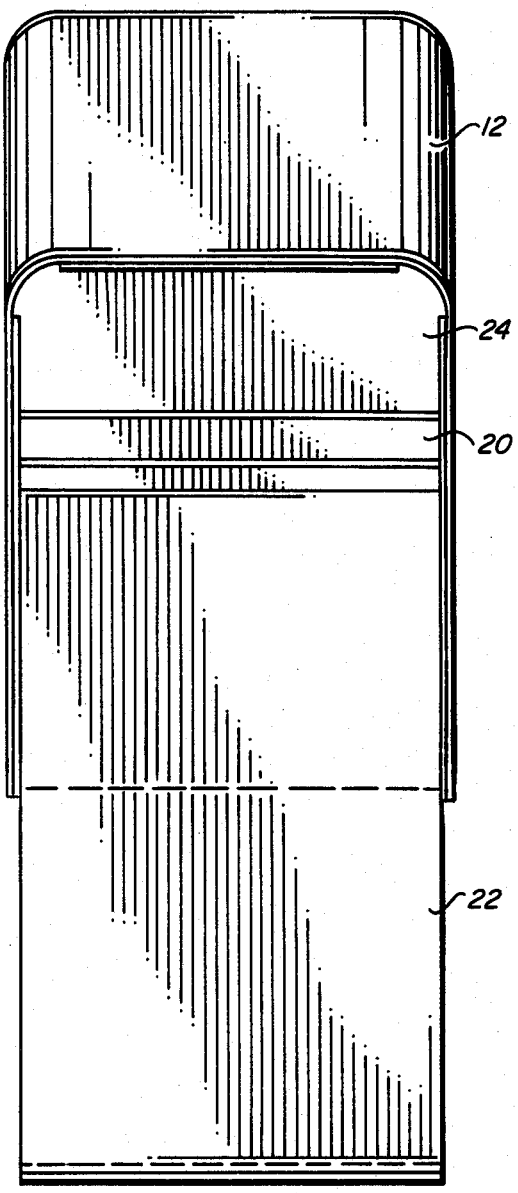
FIG. 5 is a rear elevational view of the display stand of FIG. 1.
Figure 6:
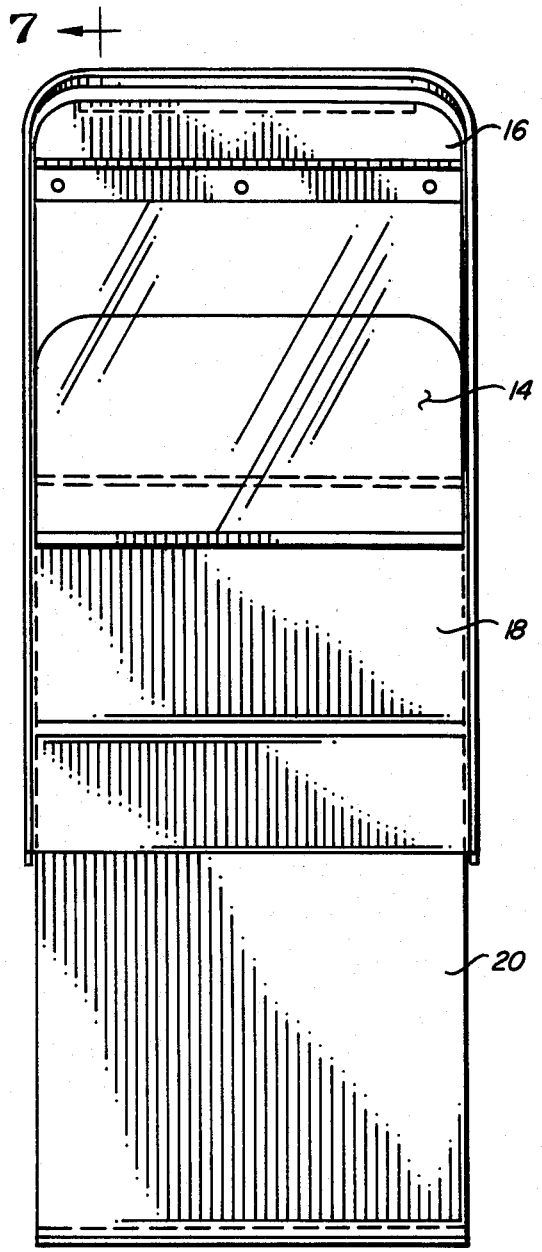
FIG. 6 is a front elevational view of the display stand of FIG. 1.
Figure 7:
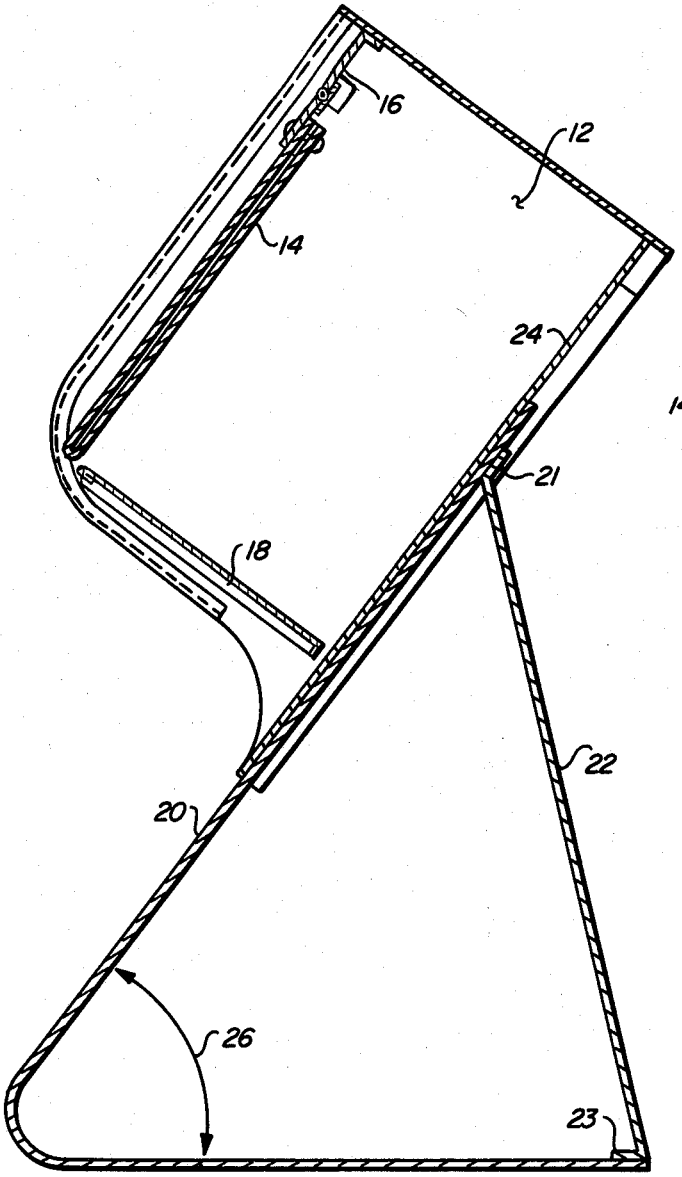
FIG. 7 is a cross sectional view of the display stand of FIG. 1 taken along the line 7—7 in the direction of the arrows shown in FIG. 6.

FIGS. 5 and 6 are rear and front elevational views, respectively, of the display stand. FIG. 7 is a cross sectional view of the display stand 10 taken along the line 7—7 in the direction of the arrows shown in FIG. 6. The straight support 22 is attached to the angled support 20 by preferably welding two elongated flanges 21 and 23 to the angled support 20. Furthermore, the angled support 20 is attached (preferably welded) to the backside 24 of the display stand 10. The straight support 22 and angled support 20 are preferably made out of sheet metal. The lid 14 is operably attached to the hinged top portion 16 which is itself attached (preferably welded) to the hood 12. Due to a hinge 28 (see FIG. 10) incorporated into the hinged top portion 16, the lid 14 may be easily opened and closed. Because the hood 12, hinged top portion 16, and lid 14 are inclined due to the angle 26, the lid 14 is kept shut by gravity. The angle 26 is preferably fifty-three degrees. Periodicals may be placed on top of the bottom plate 18 which is attached (preferably welded) to the hood 12. The periodicals will not fall out of the display stand 10 because the bottom plate 18 is also inclined due to the angle 26.

Figure 8:
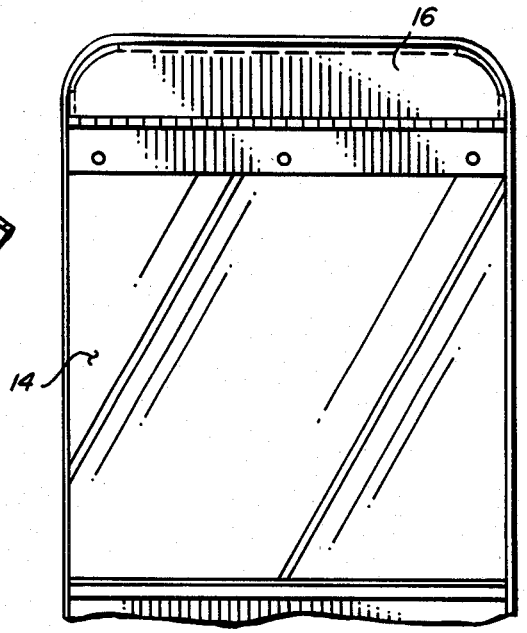
FIG. 8 is a planar view of the lid and hinged top portion of the display stand of FIG. 1 taken in the direction of the arrows 8—8 shown in FIG. 2.
Figure 9:
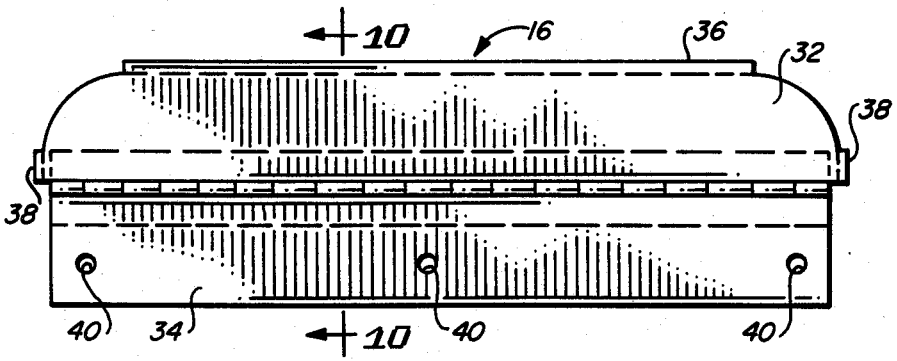
FIG. 9 is a front elevational view of the hinged top portion of the display stand of FIG. 1.
Figure 10:
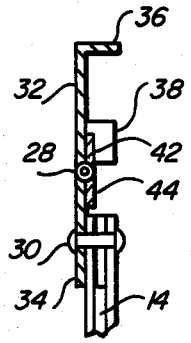
FIG. 10 is a cross sectional view of the hinged top portion of the display stand of FIG. 1 taken along the line 10—10 in the direction of the arrows shown in FIG. 9 with the lid shown attached to the hinged top portion by a rivet.

FIG. 8 is a planar view of the lid 14 and hinged top portion 16 taken in the direction of the arrows 8—8 shown in FIG. 2. A front elevational view of the hinged top portion 16 is shown in FIG. 9. FIG. 10 is a cross section view of the hinged top portion 16 taken along the line 10—10 in the direction of the arrows shown in FIG. 9. The lid 14 is preferably attached to the hinged top portion 16 by rivets 30. Note that in FIG. 10 the lid 14 is shown attached to the hinged top portion 16 by a rivet 30. The hinged top portion 16 consists of an upper part 32 and a lower part 34. The upper part 32 is attached (preferably welded) to a top part 42 of the hinge 28. In a similar manner, the lower part 34 is attached (preferably welded) to a bottom part 44 of the hinge 28. In addition, the lower part 34 has aperatures 40 for the rivets 30 which secure the lid 14 to the hinged top portion 16. Note that any other suitable fastening means such as nuts and bolts may be substituted in place of the rivets if desired. Top and side flanges 36 and 38, respectively, are used to attach (preferably weld) the hinged top portion 16 to the hood 12.

Figure 11:
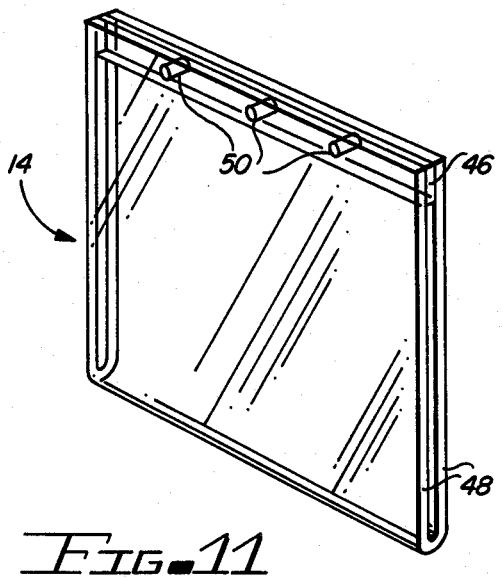
FIG. 11 is a perspective view of the lid of the display stand of FIG. 1.

Referring to FIG. 11, the lid 14 consists of a window 48 fabricated out of a generally rectangular-shaped sheet of material which can be bent as shown and an elongated block 46 that fits between the two upper ends of the sheet. Both the window 48 and elongated block 46 have aperatures 50 for the rivets 30 which hold the lid 14 to the hinged top portion 16. The window 48 and block 46 are preferably made out of a transparent material such as polycarbonate, or the like.

Figure 13:
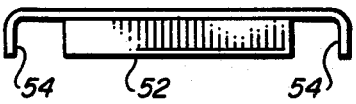
FIG. 13 is a bottom view of the backside shown in FIG. 12.

A rear elevational view of the backside 24 is shown in FIG. 12. FIG. 13 is a bottom view of the backside 24. The backside 24 consists of a generally rectangular-shaped sheet of material with rounded upper corners having an upper flange 52 and side flanges 54 used to attach (preferably weld) the backside 24 to the hood 12. The rounded upper corners of the backside 24 are shaped to fit the inside surface of the upper end of the hood 12 shown in FIG. 18. The backside 24 is preferably fabricated from sheet metal.

Figure 16:
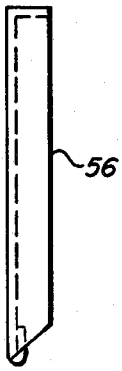
FIG. 16 is a right side view of the bottom plate shown in FIG. 14.
Figure 14:
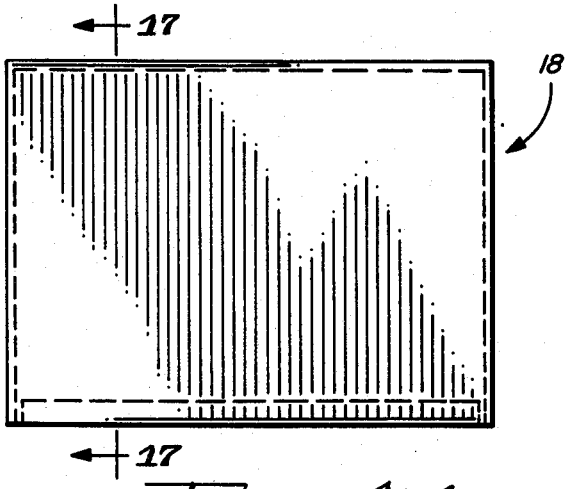
FIG. 14 is a top plan view of the bottom plate of the display stand of FIG. 1.
Figure 17:
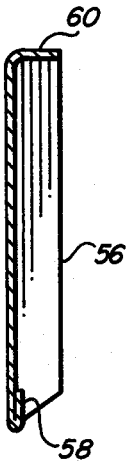
FIG. 17 is a cross sectional view of the bottom plate shown in FIG. 14 taken along the line 17—17 in the direction of the arrows shown in FIG. 14.

FIG. 14 is a top plan view of the bottom plate 18. A front elevational view of the bottom plate 18 is shown in FIG. 15. In addition, FIG. 16 is a right side view of the bottom plate 18. FIG. 17 is a cross sectional view of the bottom plate 18 taken along line 17—17 in the direction of the arrows shown in FIG. 14. The bottom plate 18 is a sheet of material (preferably sheet metal) having a rectangular shape. It has a rear flange 60, flanges 56 on both sides and a folded portion 58 at its front end. The bottom plate 18 is secured to the hood 12 by attaching (preferably welding) its flanges 56 to the hood 12.

Figure 18:
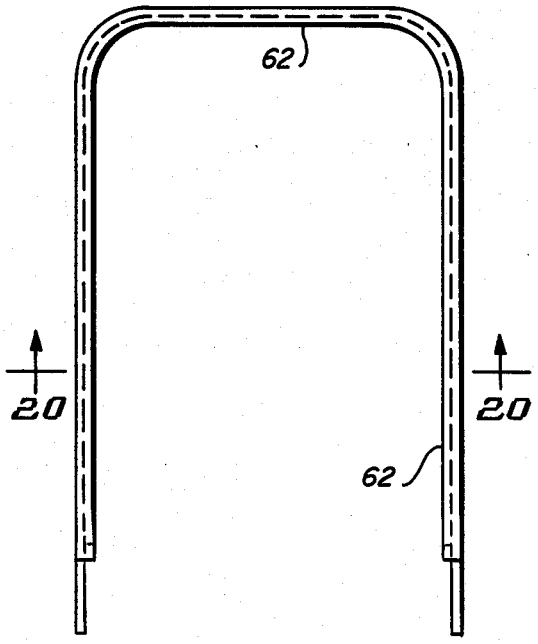
FIG. 18 is a front elevational view of the hood of the display stand of FIG. 1.
Figure 19:
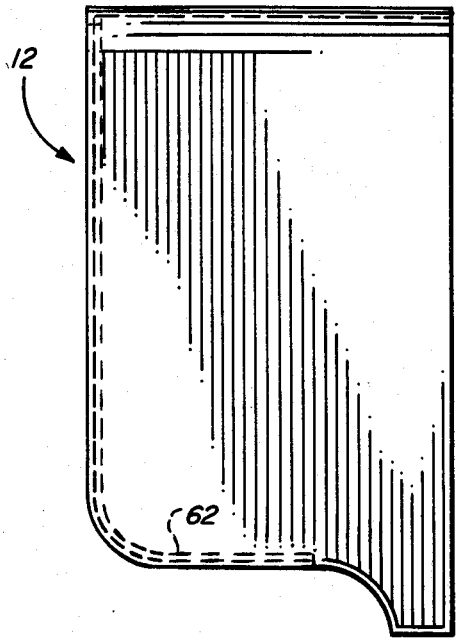
FIG. 19 is a side elevational view of the hood shown in FIG. 18.
Figure 20:
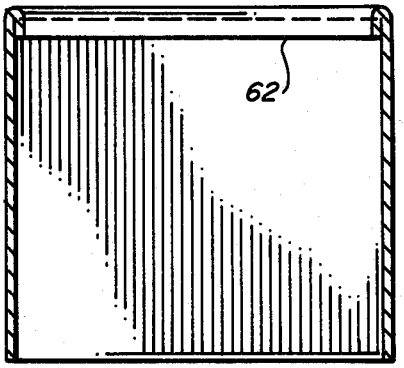
FIG. 20 is a cross sectional view of the hood shown in FIG. 18 taken along the line 20—20 in the direction of the arrows shown in FIG. 18.

A front elevational view of the hood 12 is illustrated in FIG. 18. FIG. 19 shows a side elevational view of the hood 12. Finally, FIG. 20 is a cross sectional view of the hood 12 taken along line 20—20 in the direction of the arrows shown in FIG. 18. Note that the inside surface at the upper end of the hood 12 is contoured to fit the upper end of the backside 24 (see FIG. 12). The hood is fabricated by bending an essentially rectangular-shaped sheet of material (preferably sheet metal) to the shape of an inverted U as shown in FIG. 18. It has a folded portion 62 which extends across its top front end, down the front ends of the two sides and partially across its bottom end.

The embodiment of the invention shown in FIGS. 1 through 20 is easily fabricated from sheet material (preferably sheet metal) using a minimum number of parts. It has the capacity to hold a significant number of periodicals such as newspapers which will not fall out of the display stand 10 because it is inclined due to angle 26. The public has access to the periodicals by means of the lid 14 which may be easily opened. Gravity keeps the lid 14 shut, thereby protecting the periodicals from external elements.

While the invention has been particularly shown and described in reference to preferred embodiments thereof, it will be undersood by those skilled in the art that changes in the form and details may be made therein without departing from the spirit and scope of the invention.

I claim:

1. A display stand for holding and displaying a plurality of periodicals, comprising:

a means for holding said plurality of periodicals, said means including: (a) a generally u-shaped hood means for providing a top wall member means and at least two side member wall means, (b) a backside means for securing to an open rear formed by said u-shaped hood means and (c) a bottom plate means for securing to an open bottom formed by said u-shaped hood means, suitable for providing said holding means to have an open front opposite said backside;

a closable means rotatably mounted onto said open front suitable for exposing said open front for permitting placement of said plurality of periodicals into said holding means and onto said bottom plate and for permitting removal of said plurality of periodicals from said holding means, said closable means rotatably including a lid operably hingedly secured to a hinged top portion, said hinged top portion operably secured to said generally u-shaped hood; and an inclined support means for supporting said periodicals, said closable means and said holding means and for inclining said holding means so that said bottom plate makes an acute angle with a horizontal plane in order to keep said lid shut and to prevent said periodicals from falling out of said holding means, said support means including a straight support operably secured to an angled support, said angled support being operably secured to said holding means.

2. The display stand of claim 1 wherein said hood comprises a generally rectangular-shaped sheet of material bent to substantially have the shape of an inverted U when viewed from the front, said hood having a folded portion extending across a top front end, down front ends of two sides and partially across a bottom end.

3. The display stand of claim 2 wherein said backside comprises a generally rectangular-shaped sheet of material having an upper elongated flange at a top end, an elongated flange at each of two sides and rounded corners at said top end, said rounded corners being shaped to fit an inside surface located at a top rear end of said hood, said backside being operably secured to a rear end of said hood by said elongated flanges of said backside.

4. The display stand of claim 3 wherein said bottom plate comprises a generally rectangular-shaped sheet of material having elongated flanges extending across a rear end and each of two sides and a folded portion extending across a front end, said bottom plate being operably secured to said sides of said hood by said side flanges of said bottom plate.

5. The display stand of claim 1 wherein said hinged top portion comprises an upper part and a lower part held together by a hinge, said upper part being a generally rectangular-shaped sheet of material having an elongated flange extending across a top end, rounded corners at said top end and a flange at each of two sides, said rounded corners being shaped to fit said holding means, said lower part being a generally rectangular-shaped sheet of material having a plurality of apertures therethrough, said hinge being operably secured to said upper and lower parts, said hinged top portion being operably secured to said holding means by said flanges of said upper part.

6. The display stand of claim 5 wherein said lid comprises a generally rectangular-shaped sheet of material bent so that only a narrow space separates two equal halves of said sheet, said lid having substantially a U-shaped bottom end and an elongated block placed in said narrow space between said halves of said sheet at a top end of said lid, said lid having a plurality of apertures through said halves of said sheet at said top end, said block having a plurality of apertures therethrough, said apertures in said block being in alignment with said corresponding apertures in said lid and in said lower part of said hinged top portion.

7. The display stand of claim 6 wherein said lid is operably secured to said hinged top portion by a plurality of rivets which fit through said corresponding plurality of apertures in said lid, said block and said lower part of said hinged top portion.

8. The display stand of claim 4 wherein said hinged top portion comprises an upper part and a lower part held together by a hinge, said upper part being a generally rectangular-shaped sheet of material having an elongated flange extending across a top end, rounded corners at said top end and a flange at each of two sides, said rounded corners being shaped to fit an inside surface located at a top front end of said hood, said lower part being a generally rectangular-shaped sheet of material having a plurality of apertures therethrough, said hinge being operably secured to said upper and lower parts, said hinged top portion being operably secured to said hood by said flanges of said upper part at said top front end of said hood.

9. The display stand of claim 8 wherein said lid comprises a generally rectangular-shaped sheet of material bent so that only a narrow space separates two equal halves of said sheet, said lid having substantially a U-shaped bottom end and an elongated block placed in said narrow space between said halves of said sheet at a top end of said lid, said lid having a plurality of apertures through said halves of said sheet at said top end, said block having a plurality of apertures therethrough, said apertures in said block being in alignment with said corresponding apertures in said lid and in said lower part of said hinged top portion.

10. The display stand of claim 9 wherein said lid is operably secured to said hinged top portion by a plurality of rivets which fit through said corresponding plurality of apertures in said lid, said block and said lower part of said hinged top portion.

11. The display stand of claim 1 wherein said angled support comprises a generally rectangular-shaped sheet of material bent to form an acute angle between two parts of said sheet, said sheet having a horizontal part lying in a horizontal plane and an inclined part at an acute angle from said horizontal part, said inclined part having a top portion operably secured to said holding means.

12. The display stand of claim 11 wherein said straight support comprises a generally rectangular-shaped sheet of material having elongated flanges at top and bottom ends, said straight support being operably secured to said angled support by said elongated flanges.

13. The display stand of claim 10 wherein said angled support comprises a generally rectangular-shaped sheet of material bent to form an acute angle between two parts of said sheet, said sheet having a horizontal part lying in a horizontal plane and an inclined part at an acute angle from said horizontal part, said inclined part having a top portion operably secured to said backside, said inclined part and said backside being parallel to each other.

14. The display stand of claim 13 wherein said straight support comprises a generally rectangular-shaped sheet of material having elongated flanges at top and bottom ends, said straight support being operably secured to said angled support by said elongated flanges.

15. The display stand of claim 14 wherein said acute angle of said angled support is approximately 53 degrees.

16. The display stand of claim 15 wherein said lid includes a polycarbonate material.

17. The display stand of claim 16 wherein said block includes a polycarbonate material.

18. The display stand of claim 17 wherein said sheet material for said hood, said backside, said bottom plate, said hinged top portion, said angled support and said straight support is sheet metal.

19. The display stand of claim 18 wherein said lid, said block and said lower part of said hinged top portion have three apertures and three rivets.

* * * * *